US006050030A

United States Patent [19]

Wax, Sr.

[11] Patent Number: 6,050,030

[45] Date of Patent: Apr. 18, 2000

[54] RAIN GUTTER SYSTEM FOR OVERLAPPING CORRUGATED ROOF PANELS

[76] Inventor: Roger D. Wax, Sr., 8571 S. Union Rd., Miamisburg, Ohio 45342

[21] Appl. No.: 09/089,785

[22] Filed: Jun. 3, 1998

[51] Int. Cl.[7] ..... E04D 13/064

[52] U.S. Cl. ..... 52/15; 52/11

[58] Field of Search ..... 52/75, 11, 13, 52/14, 15, 58, 60, 95

[56] References Cited

U.S. PATENT DOCUMENTS

| | | | |
|---|---|---|---|
| 2,565,282 | 8/1951 | Thompson . | |
| 2,811,935 | 11/1957 | Jones . | |
| 3,286,404 | 11/1966 | Harrison . | |
| 3,289,360 | 12/1966 | Gartner . | |
| 3,388,510 | 6/1968 | Smith et al. . | |
| 3,417,519 | 12/1968 | Hitter . | |
| 4,254,595 | 3/1981 | Crosslen | 52/11 |
| 4,411,109 | 10/1983 | Struben et al. . | |
| 4,473,973 | 10/1984 | Lane | 52/13 |
| 4,910,926 | 3/1990 | Paulsson | 52/11 |

*Primary Examiner*—Carl D. Friedman
*Assistant Examiner*—Yvonne Horton-Richardson
*Attorney, Agent, or Firm*—Jacox, Meckstroth & Jenkins

[57] ABSTRACT

Corrugated metal roof panels have overlapping opposite curled edge portions defining channels adjacent the ridge portions of the roof panels. Parallel spaced support rods have inner end portions which project into the channels and are secured by fasteners. The support rods project from the ends of the roof panels and have outer end portions secured by fasteners to the top flange on the outer wall of a U-shaped rain gutter. The inner wall of the gutter has a top flange secured by fasteners to the valley portions of the roof panels at the ends of the roof panels, and each valley portion has a lip projecting downwardly into the gutter. Tapered closure panels fill the corrugations above the inner wall of the gutter and have edge flanges crimped to the end portions of the roof panels.

20 Claims, 1 Drawing Sheet

FIG-1
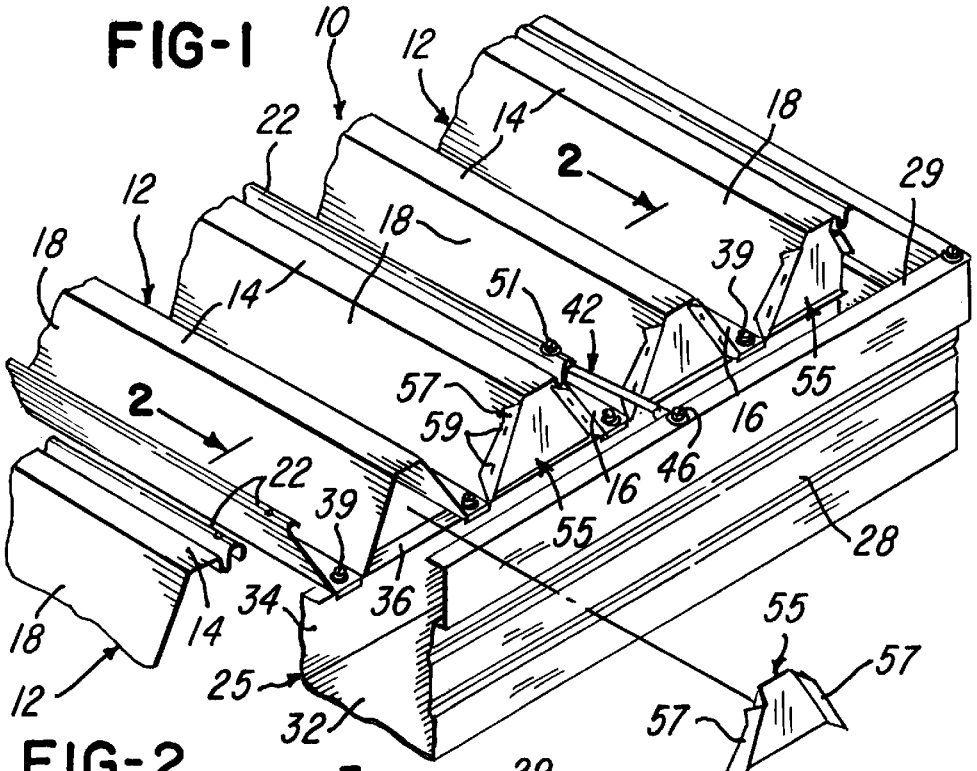
FIG-2
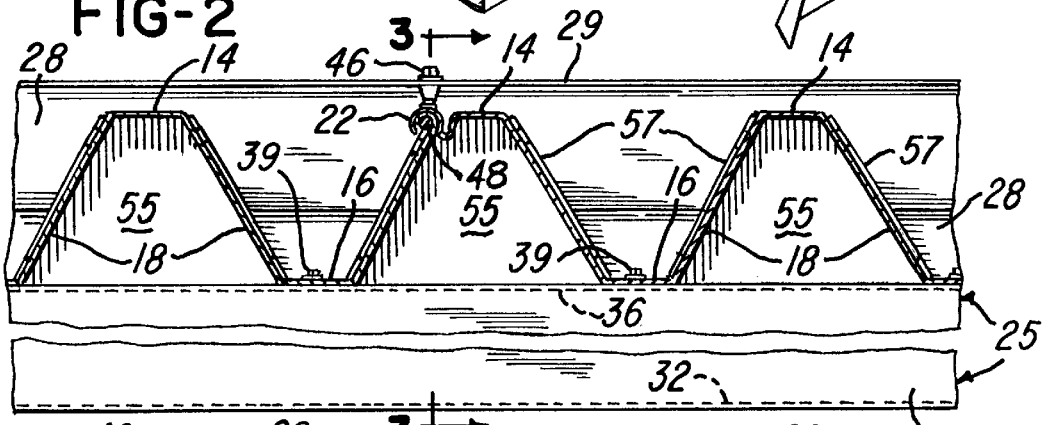
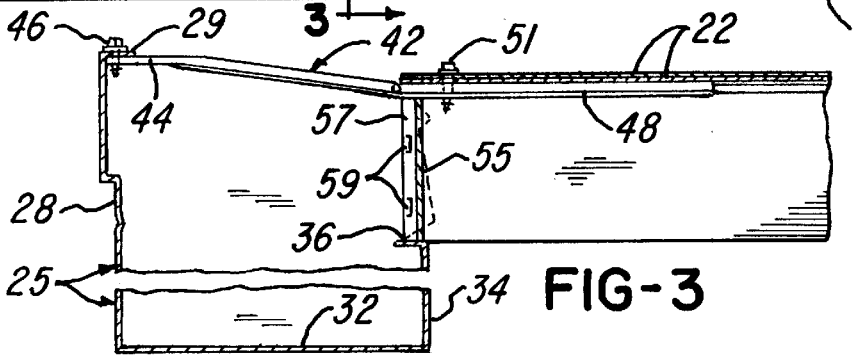
FIG-3

RAIN GUTTER SYSTEM FOR OVERLAPPING CORRUGATED ROOF PANELS

BACKGROUND OF THE INVENTION

In the construction of patio covers and carports, it is common to use elongated roll-formed aluminum roof panels which are prepainted and have a serpentine or corrugated cross-sectional configuration. The edge portions of adjacent panels overlap and are secured together, and the assembled panels are supported by a framework, usually consisting of one or more cross beams supported by vertical posts or attached to the outer wall of an existing building. The corrugated roof panels are inclined to form a shed-like roof, and usually a rain gutter is mounted on the lower end portions of the roof panels to receive water flowing down the parallel valley portions of the roof panels. The rain gutter is commonly roll-formed from aluminum sheet and has an open top box-like cross-sectional figuration with parallel inner and outer walls integrally connected by a flat bottom wall.

The outer wall of the gutter extends over the ends of the roof panels and has an inwardly projecting flange which is secured by fasteners to the ridge portions of the corrugated roof panels. The inner wall of the gutter also has an inwardly projecting flange secured to the valley portions of the roof panels with only a small gap between the outer wall of the gutter and the ends of the roof panels so that water will flow from the roof panels into the gutter. However, this conventional roof panel and gutter assembly is undesirable in that leaves, bark, twigs and other debris collect in the lower ends of the valley portions of the roof panels and the attached gutter and must be manually removed from time to time, depending upon the amount of debris produced by adjacent tress.

Since the rain gutter is commonly used to block off or cover the corrugated ends of the roof panels, it is difficult to use a gutter screen or other gutter cover with corrugated roof panels. Accordingly, it is desirable for the gutter to be located outwardly from the ends of the corrugated roof panels so that the open top gutter is easily accessible for cleaning. It is also desirable for the open top gutter to be made sufficiently large in order for debris to be washed down the gutter and down the downspouts onto the ground, thereby minimizing the need for cleaning the gutters.

One form of large open top gutter for an inclined shed-type roof is disclosed in U.S. Pat. No. 2,565,282 wherein the gutter is formed as part of a roof support frame and is constructed of a relatively heavy gauge sheet metal. However, this form of frame and gutter system is expensive. Another form of gutter support for an inclined roof assembly is disclosed in U.S. Pat. No. 4,411,109. In this patent, the roof is constructed with parallel spaced "I" beams with channel-like sheet metal panels (FIG. 6) positioned between the beams. The outer end portions of the "I" beams project from the outer ends of the sheet metal panels into the gutter (FIG. 7) to support the outer wall of an extruded aluminum rain gutter.

With any such inclined patio cover or carport roof having a rain gutter attachment, it is desirable for the roof and gutter assembly to be durable and economically constructed while also being neat and clean in appearance, and the gutter should be self-cleaning or at least easily accessible for cleaning. With corrugated roof panels, it is also desirable to eliminate a habitat for birds under the ridge portions of the corrugations and to prevent the entrance the birds, squirrels and insects into the space below the roof panels, especially when the space is enclosed by screen walls or windows.

SUMMARY OF THE INVENTION

The present invention is directed to an improved corrugated roof panels and rain gutter system and which provides all of the desirable features mentioned above. In accordance with a preferred embodiment of the invention, these advantages of features are generally provided by a roof constructed of corrugated metal roof panels which have overlapping rolled or curled edge portions which define a longitudinally extending channel between adjacent panels. A series of metal rods have inner end portions projecting into the channels and are secured by threaded fasteners. The rods project outwardly from the ends of the corrugated roof panels and support the outer wall of a relatively large open top rain gutter. The inner wall of the gutter is secured by fasteners to the valley portions of the roof panels adjacent the outer ends of the panels. A series of tapered closure panels have opposite edge flanges which are secured or crimped to the outer ends of the roof panels directly above the inner wall of the rain gutter to close the corrugations under the ridge portions and to prevent a habitat or passage for birds, squirrels, etc.

Other features and advantages of the invention will be apparent from the following description, the accompanying drawing and the appended claims.

BRIEF DESCRIPTION OF THE DRAWINGS

FIG. 1 is a fragmentary perspective view of corrugated metal roof panels and rain gutter system constructed in accordance with the invention and with portions shown exploded;

FIG. 2 is an enlarged fragmentary section taken generally on the line 2—2 of FIG. 1; and FIG. 3 is a fragmentary section taken generally on the line 3—3 of FIG. 2.

DESCRIPTION OF THE PREFERRED EMBODIMENT

An inclined patio or carport roof 10 is constructed of a plurality of corrugated sheet metal or aluminum panels 12 each having a generally "W" cross-sectional configuration. Each panel 12 includes two longitudinally extending flat ridge portions 14 and two longitudinally extending flat valley portions 16 which are integrally connected by inclined wall portions 18. Each of the panels 12 is preferably roll-formed and has rolled or curled opposite longitudinally extending edge portions 22 with one edge portion 22 being slightly larger than the opposite edge portion so that the edge portions interfit and overlap when the panels 12 are assembled, as shown in FIGS. 1 & 2.

In accordance with the present invention, the lower end portions of the roof panels 12 support a large open top gutter 25 which is preferably formed by roll-forming an aluminum sheet or strip. The gutter 25 includes an outer wall 28 with an inwardly projecting upper or top flange 29 and having a stepped cross-sectional configuration. The outer wall 28 is integrally connected by a bottom wall 32 to an inner wall 34 having an inwardly projecting upper or top flange 36 which is located substantially below the upper flange 29 on the outer wall 28. As shown in FIG. 1, the upper flange 36 on the inner wall 34 is attached or secured to the valley portions 16 of the roof panels 12 by a series of sheet metal fasteners in the form of self-tapping screws 39. Thus rain water which flows down the valley portions 16 of the roof panels 12 flows down a turn-down lip and directly into the gutter 25.

The outer wall 28 of the gutter 25 is rigidly supported by a series of parallel spaced support members in the form of cylindrical metal rods 42 each having a flattened outer end portion 44 projecting under the top flange 29 of the outer wall 28 and secured by a fastener or self-tapping screw 46. Each of the support member or rode 42 is slightly bent (FIG. 3) and has an inner portion 48 (FIG. 3) which projects into a passage or channel formed by the overlapping curled edge portions 22 of the roof panels 12. A threaded fastener or sheet metal screw 51 extends through a hole within the overlapping edge portions 22 and is threaded into a vertical cross hole formed within the rod portion 48. As shown in FIG. 3, the upper flange 29 of the outer gutter wall 28 is preferably located above the ridge portions 14 and the overlapping edge portions 22 of the roof panels 12 so that the ends of the corrugated roof panels 12 are not exposed to a person on the ground.

Referring to FIGS. 1 & 3, the open lower ends of each roof panel 12 under the ridge portions 14 are each closed by a closure panel 55 having converging folded-over opposite edge portions or flanges 57 so that each closure panel 55 has a tapered or trapezoid-shaped configuration. When a closure panel 55 is pressed onto the lower end portion of a roof panel 12 to close an opening, the closure panel 55 is located directly above the upper flange 36 on the inner gutter wall 34, and the folded-over edge flanges 57 of the closure panel grip the lower end portions of the inclined walls 18 of the roof panels 12. Each of the edge flanges 57 is then staked or crimped with two crimps 59 on each edge flange 57, as shown in FIG. 1. Thus the closure panels 55 form an extension of the inner gutter wall 34 to close the lower open ends of the roof panels 12 between the valley portions 16 and prevent a roost or passage for birds, squirrels or insects. Instead of the side flanges 57, the closure panel may be made with a bottom folded flange which receives the top flanges 36 of the gutter wall 34.

From the drawing and the above description it is apparent that the construction and assembly of the corrugated roof panels 12 and the support of the gutter 25 provide desirable features and advantages. For example, as apparent from FIG. 3, the relatively large gutter 25 has a wide open top except for the support rods 42. As a result, the gutter 25 is conveniently accessible for the removal of any debris which does not flow down the gutter and downspout. Also, the gutter 25 may be efficiently and economically constructed by roll-forming, and the support members or rods 42 provide for a high strength and economical means for supporting the outer wall 28 of the gutter 25. In addition, the inner end portions 48 of the support rods 42 are secured to the roof panels 12 in areas of the high strength, double wall overlapping edge portions 22 of the roof panels 12. This provides the outer end portions 44 of the support rods 42 with substantial strength for supporting the gutter. The rods 42 also cooperate with the upper channel portion of the stepped outer gutter wall 28 to support and resist the loading of a ladder leaned against the upper portion of the gutter wall 28. Moreover, the sheet metal closure panels 55 are also easy and convenient to install on the lower edge portions of the gutter panels 12, and the folded-over edge flanges 57 are conveniently accessible for crimping or for inserting fasteners. The closure panels 55 also provide a neat appearance to the roof from the space under the roof and are effective to prevent the roosting of birds or the passage of birds and other animals or insects into the space.

While the form of roof and gutter system herein described constitutes a preferred embodiment of the invention, it is to be understood that the invention is not limited to this precise form of system, and that changes may be made therein without departing from the scope and spirit of the invention as defined in the appended claims.

What is claimed is:

1. A rain gutter system in combination with a plurality of overlapping roof panels having valley and ridge portions defining a generally corrugated cross-sectional configuration, said system comprising an elongated open top rain gutter having longitudinally extending inner and outer walls integrally by a bottom wall, said inner wall of said gutter supported by said valley portions of said roof panels with said outer wall of said gutter spaced horizontally outwardly from corresponding ends of said roof panels, said outer wall of said gutter supported by said ridge portions of said roof panels, and a plurality of tapered closure panels located under said ridge portions of said roof panels and directly above said inner wall of said gutter.

2. A gutter system as defined in claim 1 wherein each of said closure panels has at least one double wall edge flange for securing said closure panel.

3. A gutter system as defined in claim 2 wherein said edge flanges of said closure panels are folded over and receive said outer end portions of said roof panels.

4. A gutter system as defined in claim 1 wherein said valley portion of each said roof panel includes a lip projecting downwardly into said gutter.

5. A rain gutter system in combination with a plurality of overlapping roof panels having valley and ridge portions defining a generally corrugated cross-sectional configuration, said system comprising an elongated open top rain gutter having longitudinally extending inner and outer walls integrally connected by a bottom wall, means for securing said inner wall of said gutter to said valley portions of said roof panels with said outer wall of said gutter spaced horizontally outwardly from corresponding ends of said roof panels, a plurality of horizontally spaced elongated support members having outer end portions secured to said outer wall of said gutter, said support members extending over said gutter and having corresponding inner end portions secured to said roof panels adjacent said ridge portions of said roof panels for rigidly supporting said gutter and to position said gutter for convenient access for cleaning, and a plurality of tapered closure panels positioned under said ridge portions of said roof panels and above said inner wall of said gutter.

6. A gutter system as defined in claim 5 wherein each of said closure panels has at least one double wall edge flange for securing said closure panel.

7. A gutter system as defined in claim 6 wherein said edge flanges of said closure panels are crimped to said outer end portions of said roof panels.

8. A rain gutter system in combination with a plurality of laterally connected elongated roof panels having longitudinally extending lower valley portions and upper ridge portions defining a generally corrugated cross-sectional configuration, said ridge portions of adjacent said panels spaced above said valley portions and having overlapping upper edge portions defining longitudinally extending ridge channels, said system comprising and elongated open top rain gutter having longitudinally extending inner and outer walls integrally connected by a bottom wall, said inner wall of said gutter being secured to said lower valley portions of said roof panels with said outer wall of said gutter spaced horizontally outwardly from corresponding ends of said roof panels, a plurality of horizontally spaced elongated support members having outer end portions secured to said outer wall of said gutter, and said support members extending over said gutter and having corresponding inner end portions extending into said ridge channels defined by said overlapping upper edge portions of said roof panels for rigidly supporting said outer wall of said gutter and to position said open top gutter for convenient access for cleaning.

9. A gutter system as defined in claim 8 wherein said outer wall of said gutter has an inwardly projecting upper flange disposed above said ridge portions of said roof panels, and said outer end portion of each of said support members is higher than said inner end portion.

10. A gutter system as defined in claim 8, wherein each of said elongated support members comprises a generally cylindrical solid rod.

11. A gutter system as defined in claim 10 wherein each of said roof panels has at least one curled said edge portion adjacent one of said ridge portions, and said curled edge portion receives an inner end portion of said rod.

12. A gutter system as defined in claim 10 wherein said outer wall of said gutter has an inwardly projecting upper flange, and each of said generally cylindrical rods has a generally flat outer end portion secured by a fastener to said upper flange of said outer wall.

13. A gutter system as defined in claim 8 wherein said inner wall of said gutter has an inwardly projecting upper flange, and said flange is secured by fasteners to said valley portions of said roof panels.

14. A gutter system as defined in claim 8 and including a fastener securing said inner end portion of each said support member to the corresponding said overlapping edge portions of said roof panels.

15. A rain gutter system in combination with a plurality of laterally connected elongated roof panels having longitudinally extending lower valley portions and upper ridge portions defining a generally corrugated cross-sectional configuration, said ridge portions of adjacent said panels having overlapping upper edge portions defining longitudinally extending channels, said system comprising an elongated open top rain gutter having longitudinally extending inner and outer walls integrally connected by a bottom wall, each of said inner and outer walls having an inwardly projecting top flange, a plurality of fasteners securing said inner wall of said gutter to said valley portions of said roof panels with said outer wall of said gutter spaced horizontally outwardly from corresponding ends of said roof panels, a plurality of horizontally spaced elongated support members having outer end portions secured to said top flange of said outer wall of said gutter, and said support members extending over said gutter and having corresponding inner end portions extending into said channels defined by said overlapping upper edge portions of said roof panels for rigidly supporting said outer wall of said gutter and to position said open top gutter for convenient access for cleaning.

16. A gutter system as defined in claim 15 wherein each of said elongated support members comprises a generally cylindrical solid rod.

17. A gutter system as defined in claim 15 wherein said overlapping edge portions of said roof panels are curled, and said overlapping curled edge portions receive said inner end portions of said support members.

18. A gutter system as defined in claim 15 wherein each of said support members comprises a generally cylindrical solid rod having a generally flat said outer end portion projecting under said top flange of said outer wall.

19. A gutter system as defined in claim 15 and including a plurality of tapered closure panels positioned under said ridge portions of said roof panels and above said top flange of said inner wall of said gutter.

20. A gutter system as defined in claim 19 wherein each of said closure panels has opposite folded-over edge flanges crimped to outer end portions of said roof panels.

* * * * *